US007239307B2

(12) United States Patent
Kota et al.

(10) Patent No.: US 7,239,307 B2
(45) Date of Patent: Jul. 3, 2007

(54) DRIVING CIRCUIT OF DISPLAY AND DISPLAY DEVICE

(75) Inventors: Atsushi Kota, Tokyo (JP); Shingo Kawashima, Tokyo (JP); Eitaro Nishigaki, Tokyo (JP); Yuji Kondo, Tokyo (JP)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/927,216

(22) Filed: Aug. 27, 2004

(65) Prior Publication Data

US 2005/0024357 A1 Feb. 3, 2005

Related U.S. Application Data

(63) Continuation of application No. 09/939,645, filed on Aug. 28, 2001, now Pat. No. 6,788,298.

(30) Foreign Application Priority Data

Aug. 29, 2000 (JP) ..... 2000-259984

(51) Int. Cl.
*G09G 5/00* (2006.01)

(52) U.S. Cl. ..... 345/204; 345/51; 345/76; 345/77; 345/84; 345/690

(58) Field of Classification Search ..... 345/36, 345/45, 51, 76, 77, 80, 82, 83, 84, 90, 100, 345/204, 205, 690
See application file for complete search history.

(56) References Cited

U.S. PATENT DOCUMENTS 5,585,950 A 12/1996 Nishino et al.

(Continued)

FOREIGN PATENT DOCUMENTS

| | | |
|---|---|---|
| JP | 63-24293 | 2/1988 |
| JP | 2-125289 | 5/1990 |
| JP | 3-290618 | 12/1991 |
| JP | 4-241384 | 8/1992 |
| JP | 7-230880 | 8/1995 |
| JP | 9-212128 | 8/1997 |
| JP | 10-222128 | 8/1998 |
| JP | 11-85103 | 3/1999 |
| JP | 2000-122598 | 4/2000 |
| JP | 2001-143867 | 5/2001 |
| JP | 2001-166737 | 6/2001 |
| JP | 2001-215924 | 8/2001 |

OTHER PUBLICATIONS

Korean Office Action dated Oct. 31, 2003, with partial English translation.
Japanese Office Action dated Jul. 1, 2003 with partial English translation.

*Primary Examiner*—Bipin Shalwala
*Assistant Examiner*—Vincent E. Kovalick
(74) *Attorney, Agent, or Firm*—H.C. Park & Associates, PLC

(57) ABSTRACT

A driving circuit of a display to display full color by light emitting elements is provided which can attain sufficient display characteristics even when there is a difference in characteristics of the light emitting elements and can lower power consumption. The driving circuit is used for a stripe type display in which electrical characteristics of a red light emitting organic EL (Electroluninescence) element differ greatly from those of green and blue light emitting organic EL elements in which these three light emitting elements are arranged repeatedly in a column direction in a manner that the red light emitting element is sandwiched by the green and blue light emitting elements and the driving circuit is made up of driving sections each having driving capability enough to drive the red light emitting organic EL element and other driving sections each having driving capability enough to drive the green and blue light organic EL elements.

14 Claims, 11 Drawing Sheets

U.S. PATENT DOCUMENTS 5,729,366 A * 3/1998 Yang ..... 359/13
5,745,085 A * 4/1998 Tomio et al. ..... 345/63
5,812,105 A 9/1998 Van de Ven
6,057,824 A * 5/2000 Katakura et al. ..... 345/100
6,100,103 A * 8/2000 Shim et al. ..... 438/26
6,114,715 A 9/2000 Hamada
6,339,415 B2 1/2002 Ishizuka
6,342,937 B2 1/2002 Hiroshi
6,369,785 B1 4/2002 Imai
6,479,171 B1 11/2002 Ishibashi et al.
6,559,433 B1 * 5/2003 Ozawa ..... 250/208.1
6,589,674 B2 7/2003 Li et al.
6,788,298 B2 * 9/2004 Kota et al. ..... 345/204
2003/0067455 A1 4/2003 Toshiyuki

* cited by examiner

DRIVING CIRCUIT OF DISPLAY AND DISPLAY DEVICE

The present application is a continuation of and claims, under 35 U.S.C. § 120, the benefit of U.S. patent application Ser. No. 09/939,645, filed on Aug. 28, 2001, now U.S. Pat. No. 6,788,298 which claims priority to Japanese Patent Application No. 2000-259984 filed on Aug. 29, 2000, the contents of which are fully incorporated herein by reference.

BACKGROUND OF THE INVENTION

1. Field of the Invention

The present invention relates to a driving circuit of a display and a display device and more particularly to the driving circuit of the display made up of light emitting elements including an EL (Electroluminescence) element, an LED (Light Emitting Diode) element, a VFD (Vacuum Fluorescent Display) (FED (Field Emission Display) being one of the VFDs in particular) element or a like and used to display various kinds of information, measurement results, moving pictures or still pictures and to the display device equipped with the driving circuit of the display described above.

The present application claims priority of Japanese Patent Application No. 2000-259984 filed on Aug. 29, 2000, which is hereby incorporated by reference.

2. Description of the Related Art

Conventionally, some displays are made up of light emitting elements which include an EL element, LED, VFD (FED in particular), or the like. Of them, an EL display constructed of the EL elements is considered to be promising since it has many advantages in that it can be made planar, thinner, and more lightweight, that it can provide excellent visibility by spontaneous light and can provide quick response and that it can display moving pictures. Conventionally, an inorganic EL element using inorganic materials such as ZnS:Mn (zinc sulfide:manganese) or a like is mainstream, however, an organic EL element using organic materials such as a stilbene derivative or a like has been developed recently.

FIG. 9 is a schematic perspective view for showing configurations of a conventional organic EL display made up of such the organic EL element. An organic EL display 1 shown in FIG. 9 configured so as to display full color includes a plurality of data electrodes (anodes) 3 formed on a transparent substrate 2 at specified intervals and in a stripe form, a hole injected layer 4 formed on the transparent substrate 2 and on an entire surface of the data electrodes 3, a hole transporting layer 5 formed on an entire surface of the hole injected layer 4, light emitting layers 6 to 8 each emitting a green color (G) light, red color (R) light, and blue color (B) light, respectively, arranged in order of a green color light emitting element, red color light emitting element and blue color light emitting element, in a sequentially repeated manner and in a manner to correspond to column-directional arrangement of the data electrodes 3 and arranged in a manner that the light emitting layers 6 to 8 to emit light of same color out of the light emitting layers 6 to 8 are placed consecutively in a row direction, an electron transporting layer 9 formed on entire surfaces of the hole transporting layer 5 and light emitting layers 6 to 8 and a plurality of scanning electrodes (cathode) 10 formed on the electron transporting layer 9 in a row direction at specified intervals. The transparent substrate 2 is made up of glass or a like. The data electrode 3 is made up of a transparent electrode such as ITO (Indium Tin Oxide) or a like. The hole injected layer 4 and hole transporting layer 5 are made up of a triphenyldiamine derivative, carbazole derivative or the like. The light emitting layers 6 to 8 are made up of the stilbene derivative or a like. The electron transporting layer 9 is made up of a perylene derivative. The scanning electrode 10 is made up of a metal electrode such as an aluminum film. In the above organic EL display 1, each of its regions producing the green, red, and blue colors respectively is hereinafter called an organic EL element $EL_G$, organic EL element $EL_R$, and organic EL element $EL_B$, respectively.

In the organic EL display 1 of this example, one pixel is made up of dot pixel portions consisting of the three organic EL elements $EL_G$, $EL_R$, and $EL_B$ each emitting one color out of three primary colors including green, red, and blue colors. The organic EL display 1 is called a "stripe" organic EL display since the organic EL element $EL_G$, $EL_R$ and $EL_B$ each corresponding to each of the dot pixel portions are arranged in order of the green color light emitting EL element $EL_G$, red color light emitting EL element $EL_R$, and blue color light emitting $EL_B$ in a column direction and in a sequentially repeated manner and the organic EL elements to emit light of same color, out of the organic EL element $EL_G$, $EL_R$, and $EL_B$ are consecutively arranged in a row direction. Moreover, in the organic EL display 1 of the example, a pixel portion made up of the dot pixel portions is placed at an intersection of each of the data electrodes 3 formed at specified intervals in a column direction and each of the scanning electrodes 10 formed at specified intervals in a row direction, that is, the pixel portions made up of the dot pixel portions are arranged in a matrix form, and a character, image, or a like are displayed by light-emitting of the light emitting layers 6 to 8 corresponding to an arbitrary dot pixel portion occurring when a data signal produced based on a video signal is applied to the data electrodes 3 and a scanning signal produced based on a horizontal sync signal and a vertical sync signal is applied to the scanning electrodes 10. Therefore, the above organic EL display 1 is called a "simple-matrix EL display".

FIG. 10 is a schematic block diagram showing an example of configurations of a conventional driving circuit to drive the organic EL display 1 having configurations described above. As shown in FIG. 10, each of the scanning electrodes 10 is installed from a right end toward a left end in a display region 1*a* and is routed from the left end to an outside of the display region 1*a* and is further connected to each of scanning terminals (not shown) mounted in the left end of the organic EL display 1 at specified intervals. The data electrodes 3 are divided into two portions at an approximately central place of the display region 1*a*. Each of the divided data electrodes 3 installed from the approximately central place to an upper end of the display region 1*a* is routed to an upper portion on an upper side of the display region 1*a* and is connected to each of data terminals (not shown) mounted at an upper end of the organic EL display at specified intervals. Each of the divided data electrodes 3 installed from the approximately central place to a lower end of the display region 1*a* is routed to a lower portion on a lower side of the display region 1*a* and is connected to each of data terminals mounted (not shown) at a lower end of the organic EL display 1 at specified intervals. Data signal fed from both the data terminals (not shown) existing in the upper and lower direction is applied to two data electrodes 3 existing on a same column. The above method for applying the data signal to the data electrodes 3 is called a "double scanning method". This double scanning method is employed recently since there is a need to reduce a peak current which flows through the organic EL display 1 at a time of driving the organic EL display 1 because an IC (integrated circuit) making up data electrode driving circuits 12 and 13 described later that can withstand a high voltage is not available and since it is difficult to drive all organic EL elements only by one data electrode driving circuit due to an increase in numbers of the organic EL elements to be driven by one data electrode which has occurred to meet the demand for a larger screen and higher resolution in the organic EL display 1 and since there is an increasing demand for higher luminance in the organic EL display.

The conventional driving circuit chiefly includes a controller 11, data electrode driving circuits 12 and 13 and a scanning electrode driving circuit 14. The controller 11 produces a green video signal $S_G$, red video signal $S_R$, and blue video signal $S_B$ based on a video signal $S_P$ supplied from outside and feeds them to the data electrode driving circuits 12 and 13 and further produces a horizontal scanning pulse $P_H$ and vertical scanning pulse $P_V$ based on a horizontal sync signal $S_H$ and vertical sync signal $S_V$ and feeds the horizontal scanning pulse $P_H$ to the data electrode driving circuits 12 and 13 and feeds the vertical scanning pulse $P_V$ to the scanning electrode driving circuit 14. Each of the data electrode driving circuits 12 and 13 has driving sections 15 in numbers being equivalent to the number of the data electrodes 3 and produces a data green signal $I_{DG}$, data red signal $I_{DR}$, and data blue signal $I_{DB}$ each having a specified current value, respectively, using the green video signal $S_G$, red video signal $S_R$, and blue video signal $S_B$, all of which are voltage signals, with the timing when the horizontal scanning pulse $P_H$ is fed from the controller 11 and then feeds each of them to each of corresponding data electrodes 3 in the organic EL display 1. The scanning electrode driving circuit 14, with the timing when the vertical scanning pulse $P_V$ is supplied from the controller 11, sequentially switches the scanning electrodes 10 in the organic EL display 1 for scanning.

The organic EL display 1 that can display full color described above is one that has been developed recently and EL displays that have become generally and commercially practical are organic EL displays made up of organic EL elements that can display a yellowish-orange monochrome color. Therefore, as ICs making up the data electrode driving circuit adapted to drive the EL display, only the ICs that have been prepared for the use in the organic EL display adapted to display the monochrome color and that are provided with driving sections having same current driving capability, are distributed commercially. It is a current status quo that such ICs as have been prepared for the use in the organic EL display adapted to display the monochrome color are also used in the data electrode driving circuits 12 and 13.

However, in the conventional organic EL display 1 that can display full color, as shown in FIG. 11 and FIG. 12, there are differences in electric characteristics among organic EL elements $EL_G$, $EL_R$, and $EL_B$ which are caused by differences in types of organic materials used in the light emitting layers 6 to 8 each emitting, respectively, green color light, red color light, and blue color light. FIG. 11 shows an example of applied voltage-luminance characteristics of the conventional organic EL display 1. FIG. 12 shows an example of applied voltage-current density characteristics of the conventional organic EL display 1. In FIG. 11 and FIG. 12, a curve "a" shows the characteristic of the organic EL element $EL_G$ that emits the green color light, the curve "b" shows the characteristic of the organic EL element $EL_R$ that emits the red color light and the curve "c" shows the characteristic of the organic EL element $EL_B$ that emits the blue color light. As is apparent from FIGS. 11 and 12, the characteristic of the organic EL element $EL_G$ that emits the green color light is comparatively similar to that of the organic EL element $EL_B$ that emits the blue color light. However, the characteristic of the organic EL element $EL_R$ that emits the red color light is greatly different from those of the organic EL elements $EL_G$ and $EL_B$ that emit the green color and blue color light, respectively.

For example, as shown in FIG. 11, to have each of the organic EL elements $EL_G$, $EL_R$, and $EL_B$ emit color light at luminance of about 10,000 (cd/m$^2$), though applied voltage of about 7.5 (V) and about 11.2 (V) are required to emit the green color light and blue color light respectively, the applied voltage of as high as about 14.5 (V) is required to emit the red color light. If the data electrode driving circuit is constructed of ICs, it is almost impossible to set the applied voltage individually for each color and, in ordinary cases, the applied voltage is set at 12 V to 13 V using, as a reference, the case in which the red color light is emitted by the organic EL element $EL_R$ having a worst characteristic. As shown in FIG. 11, in the case of the applied voltage being 12 V, the luminance of the red color light is about 2,800 (cd/m$^2$) while the luminance of the blue color light is about 12,000 (cd/m$^2$) and the luminance of the green color light is as high as about 50,000 (cd/m$^2$). As shown in FIG. 12, in the case of the applied voltage being 12 V, the current density of the green color light is about 430 (mA/cm$^2$) and the current density of the blue color light is about 260 (mA/cm$^2$) while the current density of the red color light is as small as about 50 (mA/cm$^2$).

Therefore, there is shortcoming in the conventional EL display in that, if the ICs that have been prepared for the use in the organic EL display adapted to display the monochrome color and for the use in data electrode driving circuits equipped with driving sections each having the same current driving capability, are used in the above data electrode driving circuits 12 and 13, in the case of emitting the red color light, sufficient luminance cannot be attained and, in the case of emitting the blue or green color light, excessive applied voltages are fed thus causing increased power consumption. This also presents problems in that a satisfactory display of full color cannot be achieved, recent demands for high definition in the display cannot be satisfied and lowering of power consumption cannot be implemented. Moreover, in recent years, strong demands for the large screen of the display have grown and, to make large a screen of the organic EL display, a double scanning method is the essential driving method. However, even when the scanning method is employed, if the number of the organic EL elements to be driven by one driving section to achieve the large screen increases, the satisfactory display of full color is made further difficult.

There is a risk that a same inconvenience as described above occurs not only in the above organic EL display adapted to display full color but also in the full color display device made up of other light emitting elements including the LED, VFD (in FED being one type of the VFD in particular) if there are the differences in characteristics of the light emitting elements to emit light of each of the green, red, and blue colors, in the applied voltage-current density characteristics, in particular.

SUMMARY OF THE INVENTION

In view of the above, it is an object of the present invention to provide a driving circuit of a display adapted to display full color using light emitting elements to emit light of each color capable of attaining a sufficient display characteristic even when there is a difference in characteristics of the light emitting elements and capable of lowering power consumption and of achieving a high picture quality and a display device equipped with the driving circuit for the display.

According to a first aspect of the present invention, there is provided a driving circuit of a display for driving the display which is made up of first to third light emitting elements in which electrical characteristics of the first light emitting element to emit light of one of three primary colors differs greatly from those of the second and third light emitting elements to emit light of other two colors and in which the first to third light emitting elements are arranged in an order in which the first light emitting element is sandwiched by the second and third light emitting elements, in a column direction in a sequentially repeated manner and in which the first to third light emitting elements to emit light of a same color are arranged consecutively in a row direction, the driving circuit including:

first driving sections each having driving capability enough to drive the first light emitting element;

second driving sections each having driving capability enough to drive the second and third light emitting elements; and wherein the first and second driving sections are arranged in an order in which the first driving section is sandwiched by the second driving sections, in a sequentially repeated manner in a column direction in a manner to correspond to column-directional arrangement of the first to third light emitting elements.

In the foregoing, a preferable mode is one wherein the driving capability is set depending on a value given by a slope of a curve showing applied voltage-luminance characteristics of a corresponding said light emitting element.

Also, a preferable mode is one wherein driving capability of the second driving sections is set depending on an average value given by slopes of curves showing applied voltage-luminance characteristics of each of the second light emitting element and the third light emitting element.

Also, a preferable mode is one wherein each of the first and second driving sections outputs, in synchronization with a horizontal sync signal, a data signal made up of a pulse of positive polarity relative to a reference voltage and having a current value based on the driving capability.

Also, a preferable mode is one wherein the first and second driving sections are so configured that a width of the pulse making up the data signal is able to be changed depending on values given by the curves showing characteristics of each of the corresponding light emitting element.

Also, a preferable mode is one wherein the display is of a simple-matrix type in which the first to third light emitting elements are placed at an intersection of each of a plurality of scanning electrodes arranged at specified intervals in a row direction and each of a plurality of data electrodes arranged at specified intervals in a column direction.

Also, a preferable mode is one wherein the display is of a passive-matrix type in which the first to third light emitting elements and a diode serving as a switching element are placed at an intersection of each of the plurality of the scanning electrodes arranged at the specified intervals in the row direction and each of the plurality of the data electrodes arranged at specified intervals in the column direction.

Also, a preferable mode is one wherein the display is so configured that the plurality of the data electrodes are divided into two portions at an approximately central place of a display region and the divided data electrodes installed from the approximately central place toward an upper end portion of the display region is routed to an upper portion on an upper side of the display region and each terminal portion of the divided data electrodes is connected to each of data terminals mounted at an upper end of the display at specified pitches and the divided data electrodes installed from the approximately central place toward a lower end portion of the display region is routed to a lower portion on a lower side of the display region and each terminal portion of the divided data electrodes is connected to each of corresponding data terminals mounted at the specified pitches.

Also, a preferable mode is one that wherein includes an integrated circuit in which, inside the integrated circuit, the first and second driving sections are arranged in the order in which the first driving section is sandwiched by the second driving sections, in a sequentially repeated manner, from a left end portion toward a right end portion of the integrated circuit in a column direction and in a manner to correspond to the column-directional arrangement of the first to third light emitting element and in which, in a lower or in an upper end portion of the integrated circuit, output pins are provided which are arranged from the left end portion to the right end portion of the integrated circuit at pitches being approximately equal to the specified pitches at which the data terminals are placed in either of an upper end portion or lower end portion of the display, in a manner to correspond to the data terminals and an output terminal corresponding to each of the first and second driving sections arranged from the left end portion to the right end portion of the integrated circuit is connected to each of the output terminals.

Furthermore, a preferable mode is one wherein the light emitting element is any one of an electroluminescence element, a light emitting diode or a vacuum fluorescent display.

According to a second aspect of the present invention, there is provided a display device having a driving circuit of the display described above.

With the above configurations, since first driving sections each having driving capability enough to drive first light emitting element and second driving sections each having driving capability enough to drive second and third light emitting elements are arranged in a sequentially repeated manner, in a column direction in an order in which the first driving section is sandwiched by the second driving sections and in a manner to correspond to a column-directional arrangement of the first to third light emitting elements, in a display adapted to display full color by using light emitting elements to emit light of each color, even when there is a difference in characteristics of light emitting elements, sufficient display characteristics can be attained and high picture quality can be achieved and power consumption can be lowered.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
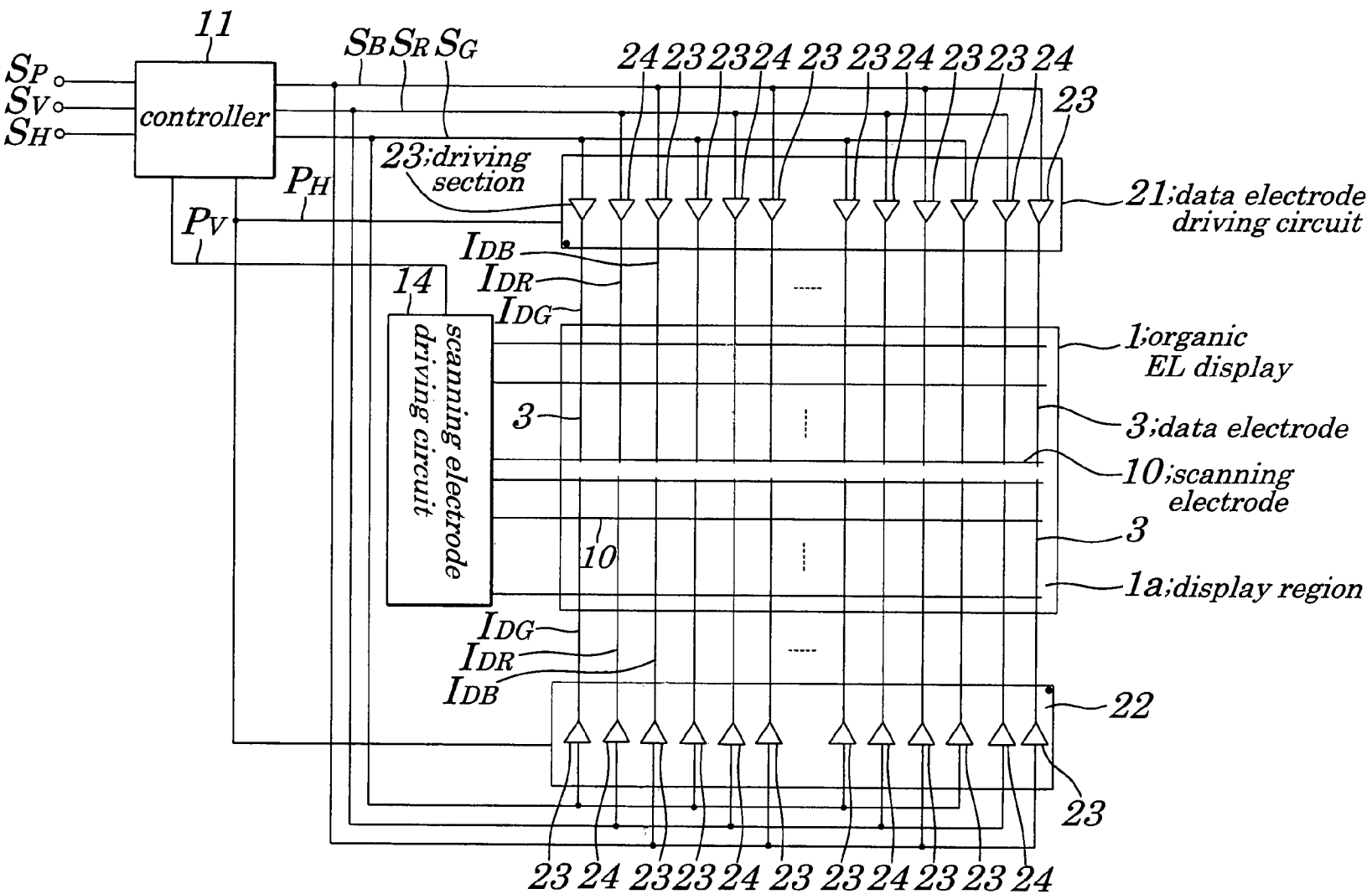
FIG. 1 is a schematic block diagram showing configurations of a driving circuit of an organic EL display according to a first embodiment of the present invention.
Figure 10:
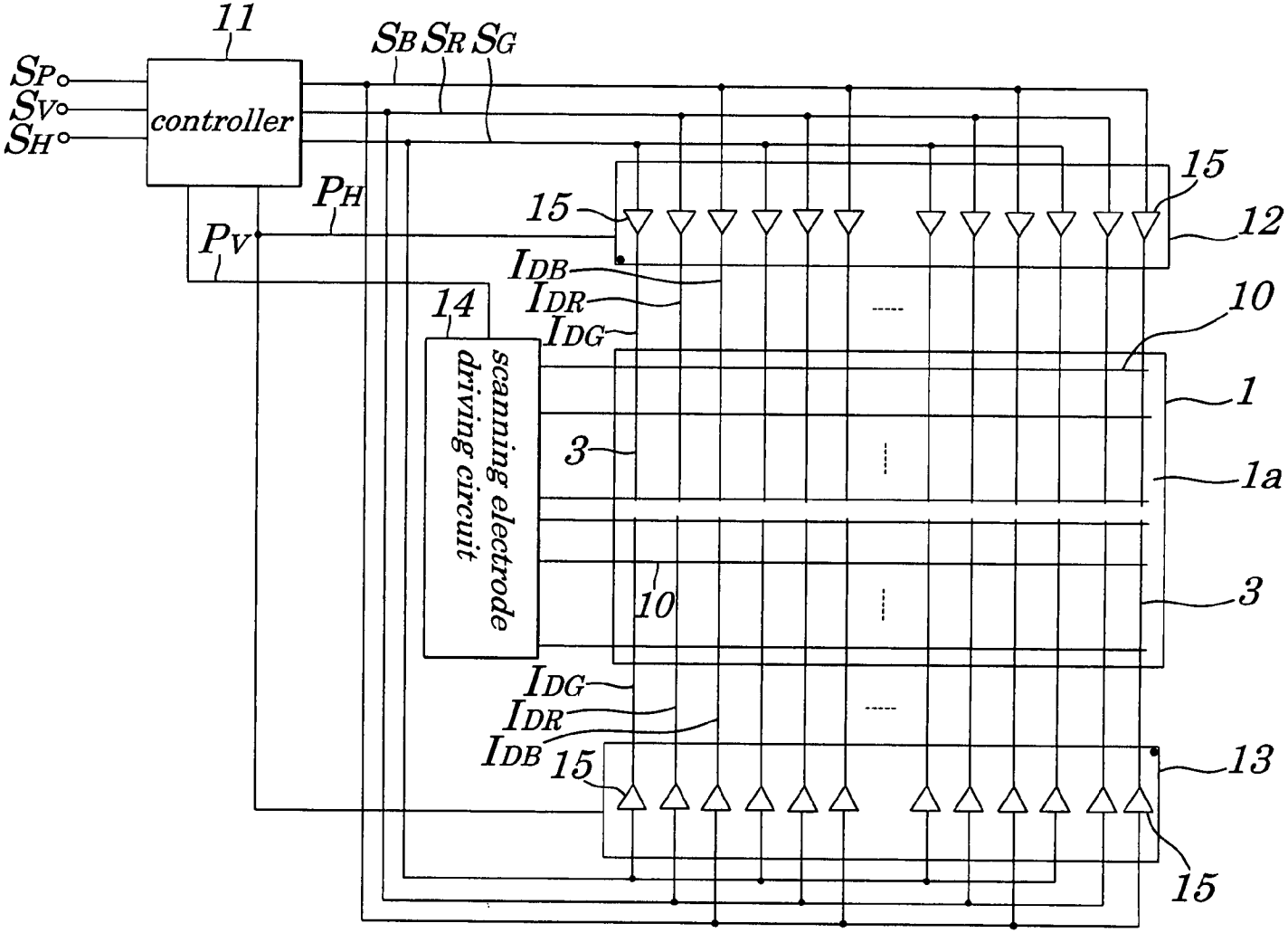
FIG. 10(PRIOR ART)
FIG. 10 is a schematic block diagram showing an example of a driving circuit of the conventional organic EL display.

FIG. 1 is a schematic block diagram showing configurations of a driving circuit of an organic EL display 1 according to a first embodiment of the present invention. In FIG. 1, same reference numbers are assigned to parts that correspond to those in FIG. 10 and their descriptions are omitted accordingly. The driving circuit of the organic EL display 1 shown in FIG. 1 is provided newly with data electrode driving circuits 21 and 22, instead of data electrode driving circuits 12 and 13 in FIG. 10.

Each of the data electrode driving circuits 21 and 22 is made up of an IC and produces, with a timing when a horizontal scanning pulse $P_H$ is fed from a controller 11, a data green signal $I_{DG}$, data red signal $I_{DR}$, and data blue signal $I_{DB}$, each of which is a current signal having a predetermined current value, from a green video signal $S_G$, red video signal $S_R$, and blue video signal $S_B$, all of which are voltage signals, respectively, and feeds each of them to each of corresponding data electrodes 3 in the organic EL display 1. Each of the data electrode driving circuits 21 and 22 is made up of an IC which contains driving sections 23 each having enough specified current driving capability to drive organic EL elements $EL_G$ and $EL_B$ adapted to emit green color light and blue color light, respectively, and driving sections 24 each having enough current driving capability to drive an organic EL element $EL_R$ adapted to emit red color light and each having current driving capability being larger than that possessed by each of the driving sections 23 and in which the driving sections 23 and 24 are arranged repeatedly in order of the driving sections 23, 24, 23, 23, 24, 23, . . . in a manner to correspond to arrangement of the organic EL elements $EL_G$, $EL_R$, and $EL_B$ arranged in a stripe form in order of the green color light emitting organic EL element $EL_G$, the red color light emitting organic EL element $EL_R$, and the blue color light emitting organic EL element $EL_B$.

That is, in the IC making up the data electrode driving circuit 21, in its internal portion, the driving sections 23 and 24 are arranged in a repeated manner in order of the driving sections 23, 24, 23, 23, 24, 23, . . . in a direction from its left end portion toward its right end portion and, in its lower end portion, output pins (not shown) are mounted in a direction from its left end portion toward its right end portion at a pitch being approximately equal to a specified pitch at which data terminals (not shown) are formed in an upper end portion of the organic EL display 1, in a manner that the output pins correspond to the data terminals (not shown), and each of output terminals each corresponding to each of the driving sections 23 and 24 arranged in the direction from the left end portion toward the right end portion of the IC is connected to each of the output pins. On the other hand, configurations of the IC making up the data electrode driving circuit 22 are the same as those of the IC making up the data electrode driving circuit 21, however, in the data electrode driving circuit 22, the IC is reversed upside down and is mounted in a direction opposite to the lower end portion of the organic EL display 1. That is, in FIG. 1, a marker indicated by a black circle in a lower left end portion of the data electrode driving circuit 21 which represents a position of the output pin used as a positional reference, is placed in a right upper end portion of the data electrode driving circuit 22.

Figure 2:
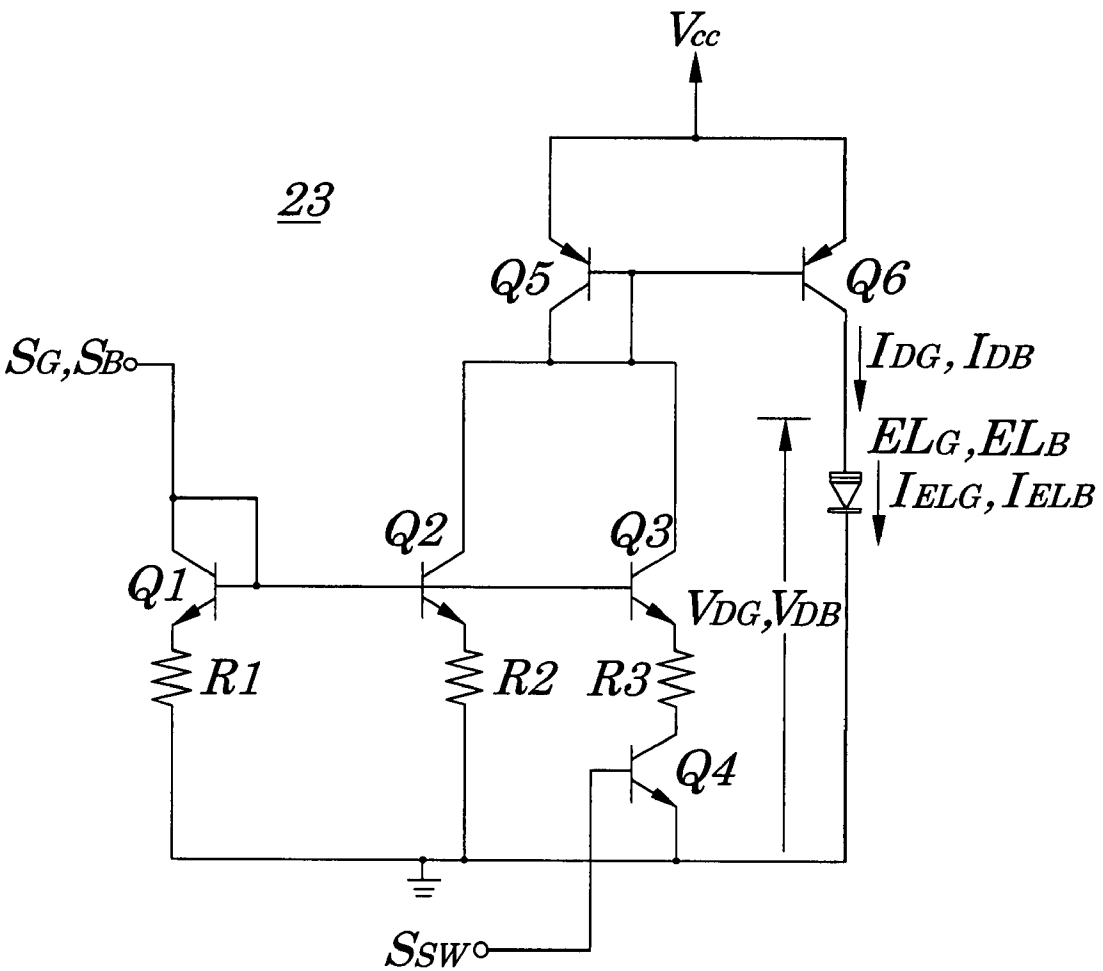
FIG. 2 shows one example of configurations of a driving section employed in a data electrode driving circuit according to the first embodiment of the present invention.

FIG. 2 shows one example of configurations of the driving section 23 employed in the data electrode driving circuits 21 and 22 according to the first embodiment of the present invention. The driving section 23 of the example is made up of bipolar transistors Q1 to Q6 and of resistors R1 to R3 and feeds a data green signal $I_{DG}$ or a data blue signal $I_{DB}$ through the data electrode 3 connected to its output terminal to the organic EL elements $EL_G$ or $EL_B$ which emits the green color light or blue color light. The bipolar transistors Q1 and Q2 make up a current mirror circuit and the bipolar transistors Q1 and Q3 make up another current mirror circuit and the bipolar transistors Q5 and Q6 make up another current mirror circuit. A current ratio between the bipolar transistors Q1 and Q2 is 1:1 while the current ratio between the bipolar transistors Q1 and Q3 is 1:6. The current ratio in the latter case is calculated from a slope of the curves "a" and "c" showing the applied voltage-luminance characteristic and the ratio is achieved by configuring the bipolar transistors Q1, Q3 so that an emitter area of the bipolar transistor Q3 is made larger by about six times than an emitter area of the bipolar transistor Q1. Same method is applied to other current mirror circuits. The bipolar transistor Q4 is turned ON when a "high" control signal $S_{SW}$ fed from a control section (not shown) mounted in the data electrode driving circuits 21 and 22 is supplied, thereby activating the bipolar transistor Q3. The current mirror circuit made up of the bipolar transistors Q5 and Q6 forms each of active loads of the current mirror circuit made up of the bipolar transistors Q1 and Q2 and of the current mirror circuit made up of the bipolar transistors Q1 and Q3. The resistors R1 to R3 are emitter resistors of the bipolar transistors Q1 to Q3 respectively.

Figure 3:
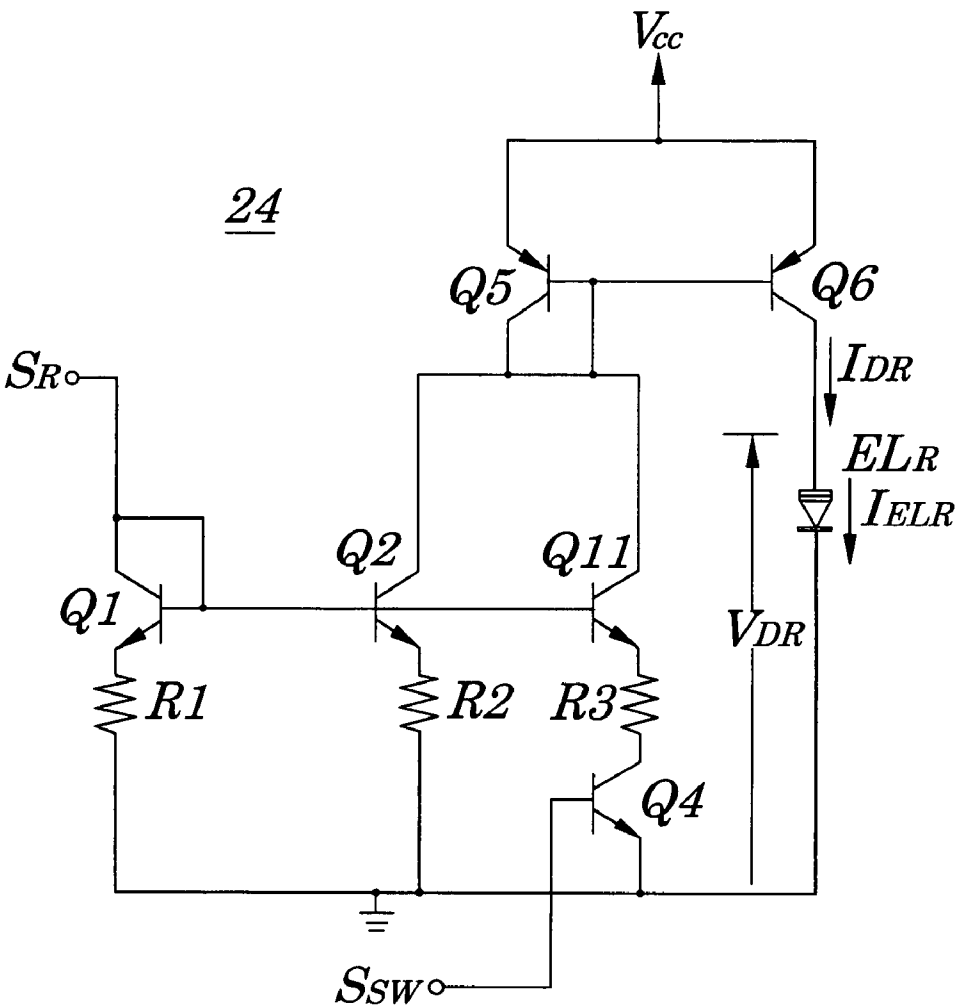
FIG. 3 shows one example of configurations of another driving section employed in the data electrode driving circuit according to the first embodiment of the present invention.
Figure 11:
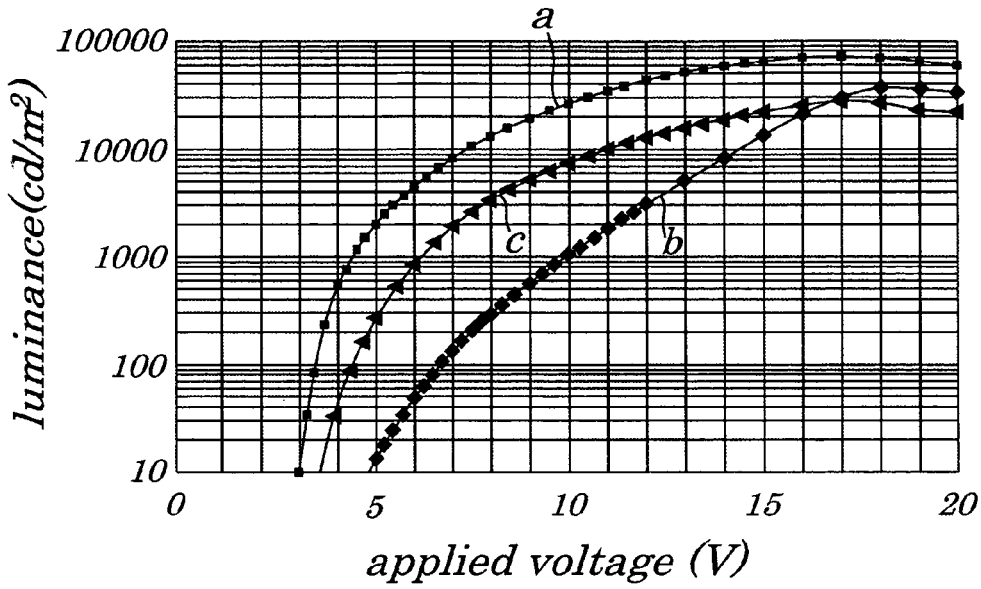
FIG. 11 (PRIOR ART)
FIG. 11 shows an example of applied voltage-luminance characteristics of the conventional organic EL display.
Figure 12:
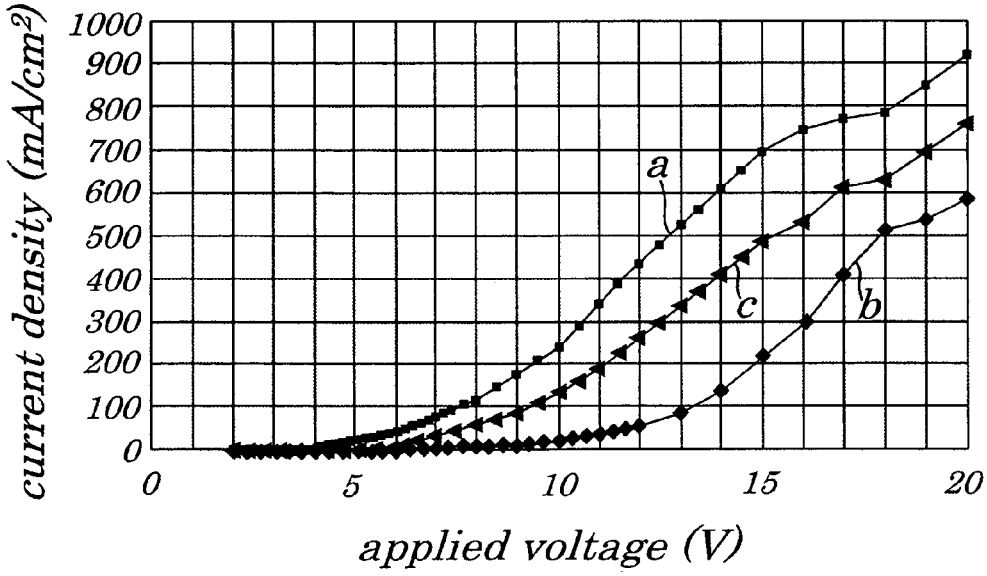
FIG. 12 (PRIOR ART)
FIG. 12 shows an example of applied voltage-current density characteristics of the conventional organic EL display.

FIG. 3 shows one example of configurations of the driving section 24 employed in the data electrode driving circuits 21 and 22 according to the first embodiment of the present invention. In FIG. 3, same reference numbers are assigned to parts that correspond to those in FIG. 2 and their descriptions are omitted accordingly. In the driving circuit 24 in FIG. 3, instead of the bipolar transistor Q3, a bipolar transistor Q11 is newly provided. The driving section 24 of the embodiment feeds a data red signal $I_{DR}$ through the data electrode 3 connected to its output terminal to the organic EL element $EL_R$ adapted to emit the red color light. The bipolar transistors Q1 and Q11 make up a current mirror circuit. A current ratio between the bipolar transistor Q1 and bipolar transistor Q11 is 1:10. This current ratio is calculated from a slope of the curve "b" showing the applied voltage-luminance characteristic shown in FIG. 11.

Figure 4:
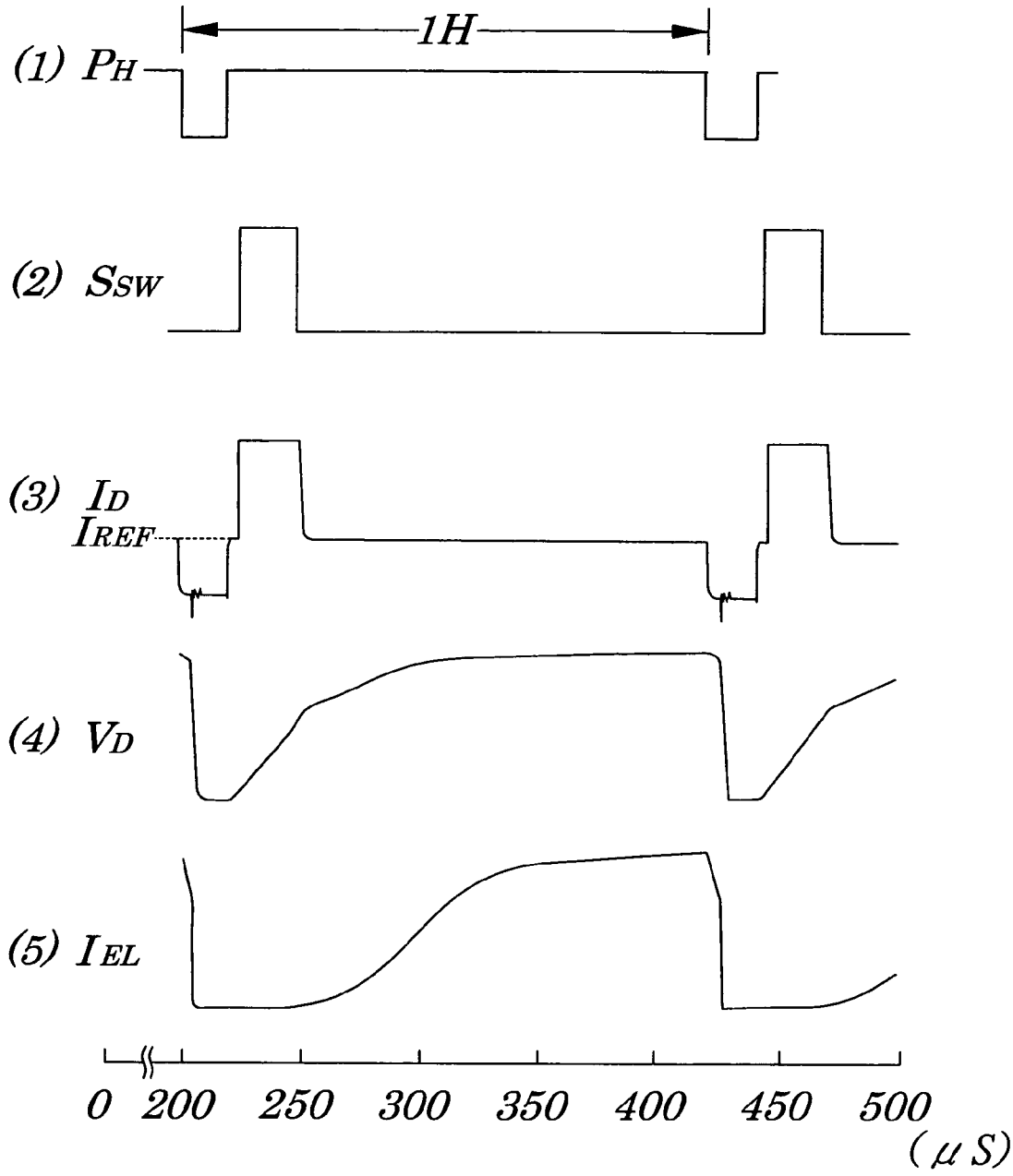
FIG. 4 is a timing chart explaining operations of the data electrode driving circuit according to the first embodiment of the present invention.

Next, operations of the data electrode driving circuits 21 and 22 making up the driving circuit of the organic EL display 1 having configurations described above by referring to a timing chart shown in FIG. 4. FIG. 4 is the timing chart explaining operations of the data electrode driving circuits 21 and 22 according to the first embodiment of the present invention. In a waveform (1) as shown in FIG. 4, "1H" denotes one scanning period. When the green video signal $S_G$, red video signal $S_R$, and blue video signal $S_B$ with a horizontal scanning pulse $P_H$ superimposed are fed to the data electrode driving circuits 21 and 22 from the controller 11 (see the waveform (1) in FIG. 4), the current mirror circuit made up of the bipolar transistors Q1 and Q2 of the driving sections 23 and 24 constructing the data electrode driving circuits 21 and 22 is operated, however, while the horizontal scanning pulse $P_H$ is at a low level, the level of the data signal $I_D$ fed from the current mirror circuit made up of the bipolar transistors Q5 and Q6 serving as an active load remains "0" (zero) (see a waveform (3) in FIG. 4). This causes no application of the data voltage $V_D$ to the corresponding organic EL element (see a waveform (4) in FIG. 4) and thus causes no flowing of an organic EL current $I_{EL}$ (see a waveform (5) in FIG. 4). This processing is called "pre-charging".

Next, after lapse of a predetermined period of time since the horizontal scanning pulse $P_H$ changed from a low to a high, as shown as a waveform (2) in FIG. 4, a high control signal $S_{SW}$ is fed to the driving sections 23 and 24 from a control section mounted in the data electrode driving circuits 21 and 22 and, while the control signal $S_{SW}$ is at a high level, the bipolar transistor Q4 is turned ON and therefore during the above period of time, the bipolar transistors Q3 and Q11 are activated. Because of this, in the driving sections 23 and 24, not only the current mirror circuit made up of the bipolar transistors Q1 and Q2 but also the current mirror circuit made up of the bipolar transistors Q1 and Q3 or the current mirror circuit made up of the bipolar transistors Q1 and Q11 is activated and the data signal $I_D$ consisting of a pulse of positive polarity relative to a reference current $I_{REF}$ is fed, while the control signal $S_{SW}$ is at a high level, from the current mirror circuit made up of the bipolar transistors Q5 and Q6 serving as the active load to the data electrode 3 connected to the output terminal of the driving sections 23 and 24 as shown as the waveform (3) in FIG. 4. Therefore, since the current corresponding to the 1-to-6 current ratio between the bipolar transistors Q1 and Q2 flows through the data electrode 3 corresponding to the organic EL element $EL_G$ and the organic EL element $EL_B$, the data voltage $V_D$ having the waveform (4) shown in FIG. 4 is produced across each of the organic EL element $EL_G$ and the organic EL element $EL_B$ and, at the same time, the organic EL current $I_{EL}$ shown as the waveform (5) in FIG. 4 flows through the organic EL element $EL_G$ and the organic EL element $EL_B$. On the other hand, since the current corresponding to the 1-to-10 current ratio between the bipolar transistors Q1 and Q11 flows through the data electrode 3 corresponding to the organic EL element $EL_R$, the data voltage $V_D$ having the waveform (4) shown in FIG. 4 is produced across the organic EL element $EL_R$, at the same time, the organic EL current $I_{EL}$ shown as the waveform (5) in FIG. 4 flows through the organic EL element $EL_R$. Thus, the organic EL elements $EL_G$, $EL_R$, and $EL_B$ emit the green color light, red color light, and blue color light, respectively.

Thus, according to the first embodiment of the present invention, the organic EL display 1 in which the organic EL elements $EL_G$, $EL_R$, and $EL_B$ are arranged in the stripe form in order of the EL element $EL_G$, $EL_R$, and $EL_B$ emitting the green color light, red color light, and blue color light respectively and in which the applied voltage-luminance characteristics or the applied voltage-current density characteristics of the organic EL element $EL_R$ adapted to emit the red color light differ greatly from those of the organic EL elements $EL_G$ and $EL_B$ adapted to emit the green color and blue color light respectively, is driven by using the data electrode driving circuits 21 and 22 made up of the IC in which the driving section 23 having enough specified current driving capability to drive the organic EL elements $EL_G$ and $EL_B$ and the driving section 24 having enough current driving capability to drive the organic EL element $EL_R$ adapted to emit the red color light and having the current driving capability being larger than that possessed by the driving sections 23 are arranged in a manner to correspond to arrangement of the organic EL elements $EL_G$, $EL_R$, and $EL_B$. This enables sufficient luminance to be attained even in a case of emitting the red color light and power consumption to be lowered even in a case of emitting the blue or green color light owing to proper application of the applied voltage. Therefore, it is possible to achieve satisfactory full color display and to respond to a demand for high picture quality. Moreover, even in an organic EL display employing the double scanning method, since the data electrode driving circuit 21 can be used as the data electrode driving circuit 22 by reversing, upside down, the IC making up the data electrode driving circuit 21, high general versatility can be provided accordingly.

Second Embodiment

Figure 5:
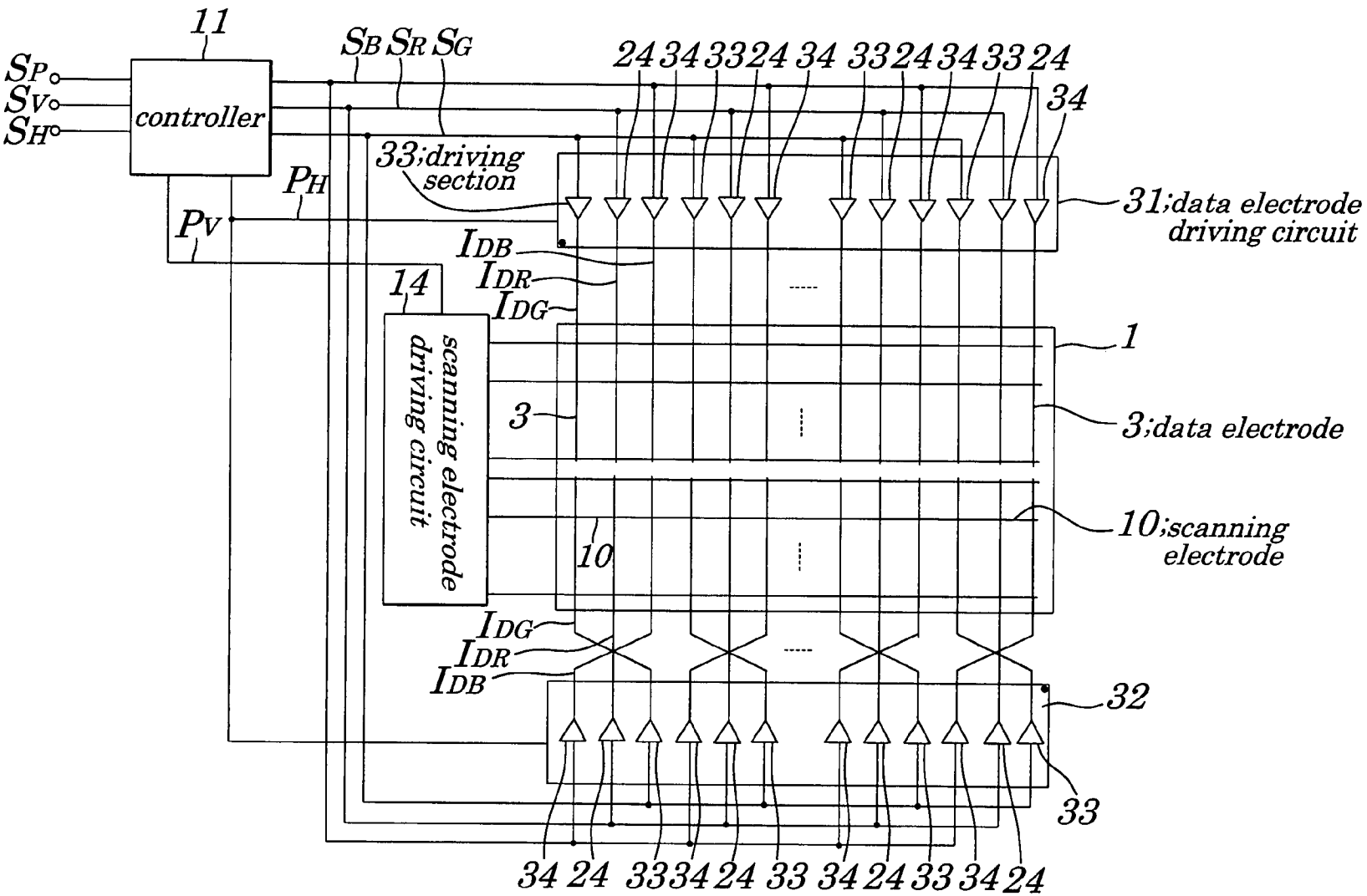
FIG. 5 is a schematic block diagram showing configurations of a driving circuit of an organic EL display according to a second embodiment of the present invention.

FIG. 5 is a schematic block diagram showing configurations of a driving circuit of an organic EL display 1 according to a second embodiment of the present invention. In FIG. 5, same reference numbers are assigned to parts that correspond to those in FIG. 1 and their descriptions are omitted accordingly. In the driving circuit of the organic EL display 1 shown in FIG. 1, instead of data electrode driving circuits 21 and 22, data electrode driving circuits 31 and 32 are newly provided.

Each of the data electrode driving circuits 31 and 32, with a timing when a horizontal scanning pulse $P_H$ is fed from a controller 11, produces a green video signal $S_G$, red video signal $S_R$, and blue video signal $S_B$ each being a current signal having a specified current value by using a data green signal $I_{DG}$, data red signal $I_{DR}$, and data blue signal $I_{DB}$ each being a voltage signal and feeds produced signals to each of corresponding data electrodes 3 of the organic EL display 1.

Figure 9:
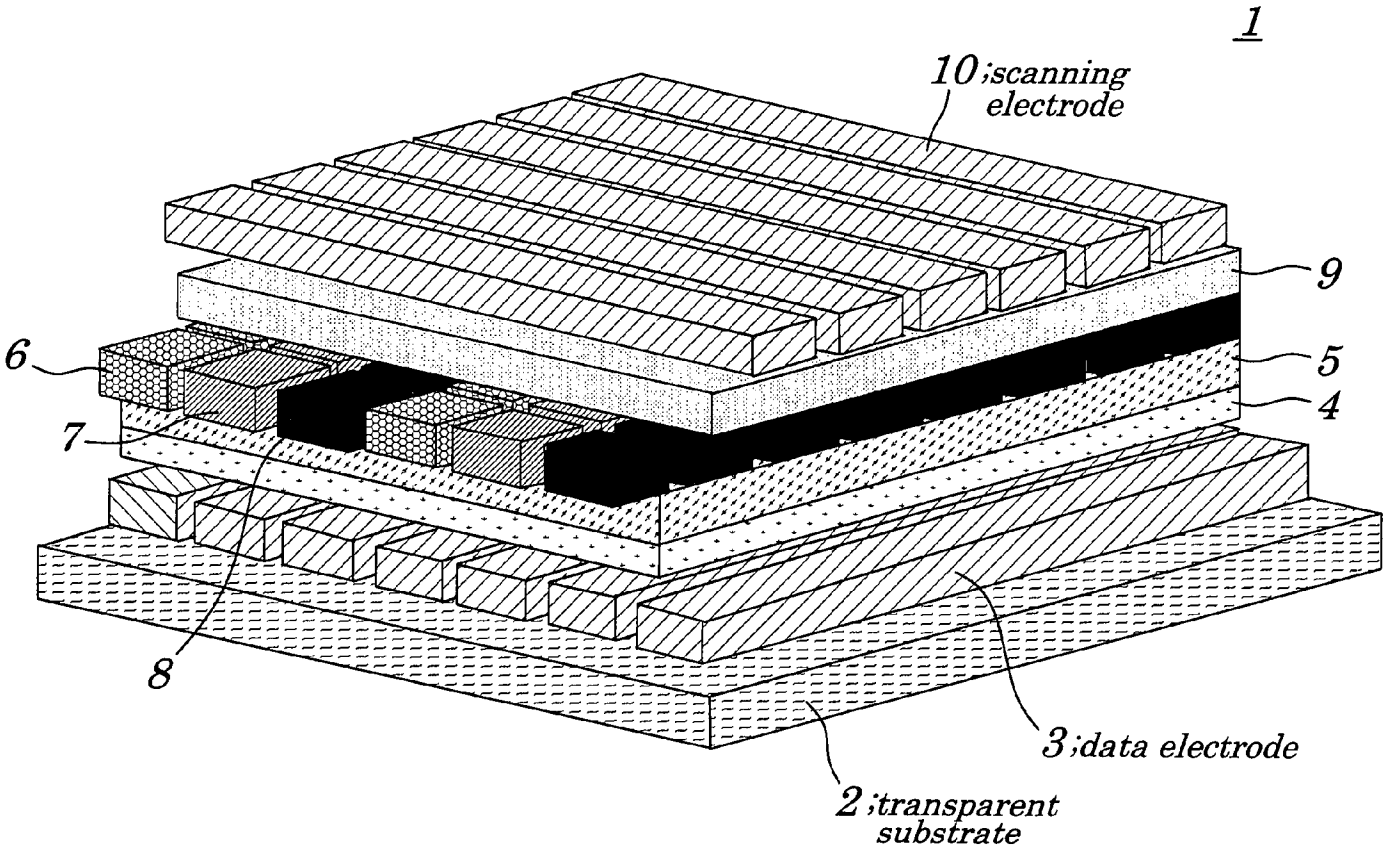
FIG.9(PRIOR ART)
FIG. 9 is a schematic perspective view showing configurations of a conventional organic EL display.

Each of the data electrode driving circuits 31 and 32 is made up of an IC which contains driving sections 33 each having enough specified current driving capability to drive the organic EL element $EL_G$ adapted to emit green color light and driving sections 34 each having enough current driving capability to drive an organic EL element $EL_B$ adapted to emit blue color light and further driving sections 24 each having current driving capability being larger than that possessed by each of the driving sections 33 and 34 and in which the driving sections 33, 24, and 34 are arranged in a repeated manner in order of the driving sections 33, 24, 34, 33, 24, 34, . . . in a manner to correspond to arrangement of the organic EL elements $EL_G$, $EL_R$, and $EL_B$ arranged in a stripe form in order of the green color light emitting organic EL element $EL_G$, the red color light emitting organic EL element $EL_R$, and the blue color light emitting organic EL element $EL_B$ (refer to light emitting layers in FIG. 9).

That is, in the IC making up the data electrode driving circuit 31 as shown in FIG. 5, in its internal portion, the driving sections 33, 24 and 34 are arranged in a repeated manner in order of the driving sections 33, 24, 34, 33, 24, 34, . . . in a direction from its left end portion toward its right end portion and, in its lower end portion, output pins are mounted in a direction from its left end portion toward its right end portion at a pitch being approximately equal to a specified pitch at which data terminals are formed in an upper end portion of the organic EL display 1, in a manner that the output pins correspond to the data terminals, and each of output terminals each corresponding to each of the driving sections 33, 24 and 34 arranged in the direction from the left end portion toward the right end portion of the IC is connected to each of the output pins. On the other hand, configurations of the IC making up the data electrode driving circuit 32 are the same as those of the IC making up the data electrode driving circuit 31, however, in the data electrode driving circuit 32, the IC is reversed upside down and is mounted in a direction opposite to a lower end of the organic EL display 1. That is, in FIG. 5, a marker indicated by a black circle in a lower left end portion of the data electrode driving circuit 31 which represents a position of the output pin used as a positional reference, is placed in a right upper end portion of the data electrode driving circuit 32. However, in the data electrode driving circuit 32, wiring is changed so that each of the output pins connected to the output terminal of each of the driving sections 33 is connected to each of the data electrodes 3 to which the green color light emitting organic EL element $EL_G$ is connected and so that each of the output pins connected to the output terminal of each of the driving sections 34 is connected to each of the data electrodes 3 to which the blue color light emitting organic EL element $EL_B$ is connected.

Figure 6:
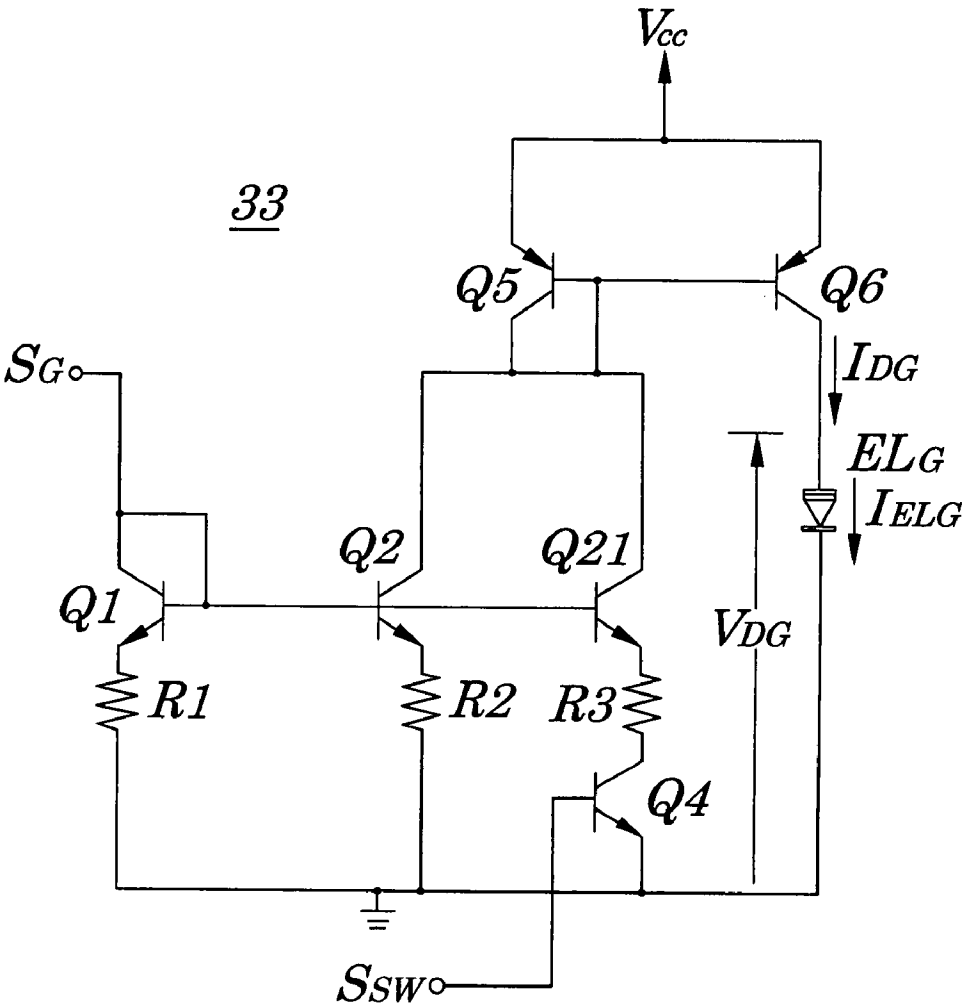
FIG. 6 shows one example of configurations of a driving section employed in a data electrode driving circuit according to the second embodiment of the present invention.

FIG. 6 shows one example of configurations of the driving section 33 employed in the data electrode driving circuits 31 and 32 according to the second embodiment of the present invention. In FIG. 6, same reference numbers are assigned to parts that correspond to those in FIG. 2 and their descriptions are omitted accordingly. In the driving section 33 shown in FIG. 6, instead of a bipolar transistor Q3 shown in FIG. 2, a bipolar transistor Q21 is newly provided. The driving section 33 of the embodiment feeds data green signal $I_{DG}$ through the data electrode 3 connected to its output terminal to the green color light emitting organic EL element $EL_G$. The bipolar transistors Q1 and Q21 make up a current mirror circuit. A current ratio between the bipolar transistors Q1 and Q21 is, for example, 1:5. The current ratio is calculated from a slope of a curve "a" showing an applied voltage-luminance shown in FIG. 11.

Figure 7:
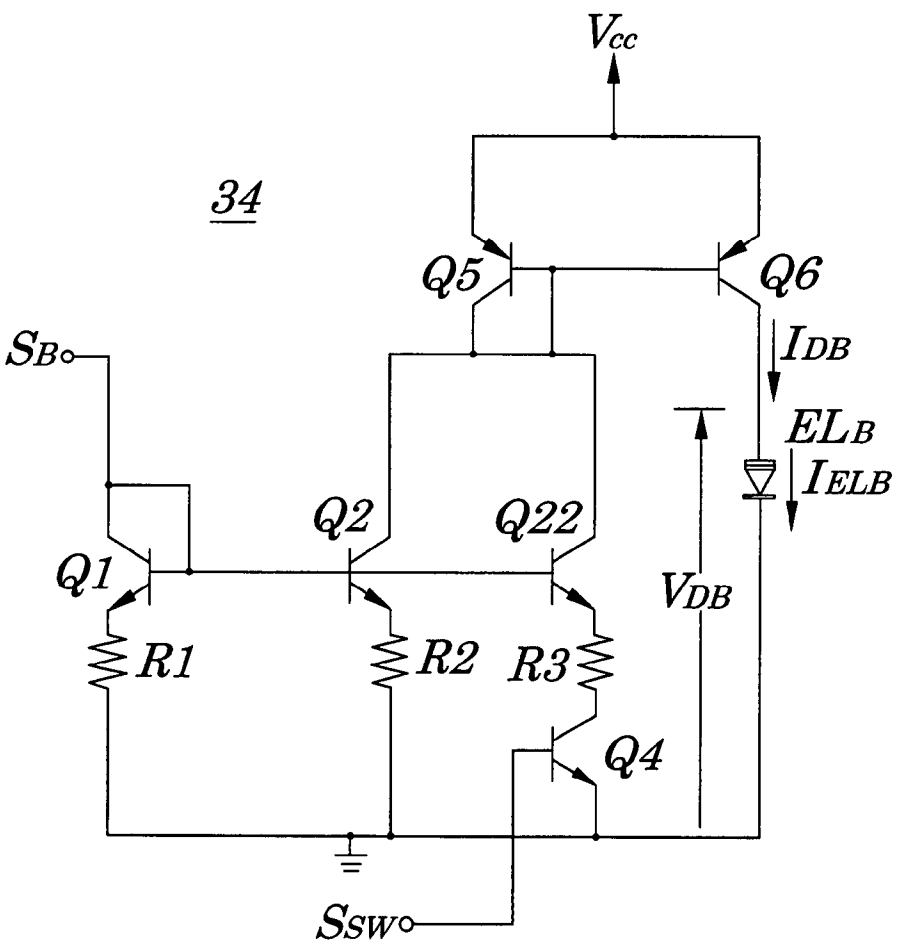
FIG. 7 shows one example of configurations of another driving section employed in the data electrode driving circuit according to the second embodiment of the present invention.

FIG. 7 shows one example of configurations of the driving section 34 employed in the data electrode driving circuits 31 and 32 according to the second embodiment of the present invention. In FIG. 7, same reference numbers are assigned to parts that correspond to those in FIG. 2 and their descriptions are omitted accordingly. In the driving section 34 shown in FIG. 7, instead of a bipolar transistor Q3 shown in FIG. 2, a bipolar transistor Q22 is newly provided. The driving section 34 feeds the data blue signal $I_{DB}$ through the data electrode 3 connected to its output terminal to the blue color emitting organic EL element $EL_B$. The bipolar transistors Q1 and Q22 make up a current mirror circuit. A current ratio between the bipolar transistors Q1 and Q22 is, for example, 1:7. The current ratio is calculated from a slope of a curve "c" showing an applied voltage-luminance shown in FIG. 11. Moreover, operations of the data electrode driving circuits 31 and 32 making up the organic EL display 1 having the configurations as described above are the same as those in the first embodiment and their descriptions are omitted accordingly.

Thus, according to the second embodiment of the present invention, the organic EL display 1 in which the organic EL elements $EL_G$, $EL_R$, and $EL_B$ are arranged in a stripe form in order of the green color light emitting organic EL element $EL_G$, red color light emitting organic EL element $EL_R$, and blue color light emitting organic EL element $EL_B$ and in which the applied voltage-luminance characteristics or the applied voltage-current density characteristics of the green color light emitting organic EL element $EL_G$, red color light emitting EL element $EL_R$, and blue color light emitting EL element $EL_B$ are different from each other, is driven by using the data electrode driving circuits 31 and 32 made up of the IC in which the driving sections 33, 24 and 34 each having enough specified current driving capability to drive each of the organic EL elements $EL_G$, $EL_R$, and $EL_B$ are arranged in a manner to correspond to the arrangement of the organic EL elements $EL_G$, $EL_R$, and $EL_B$. This enables sufficient luminance to be attained in a case of emitting any of the green color, red color, and blue color light and power consumption to be lowered more owing to proper application of the applied voltage to each of the organic EL elements $EL_G$, $EL_R$, and $EL_B$.

Figure 8:
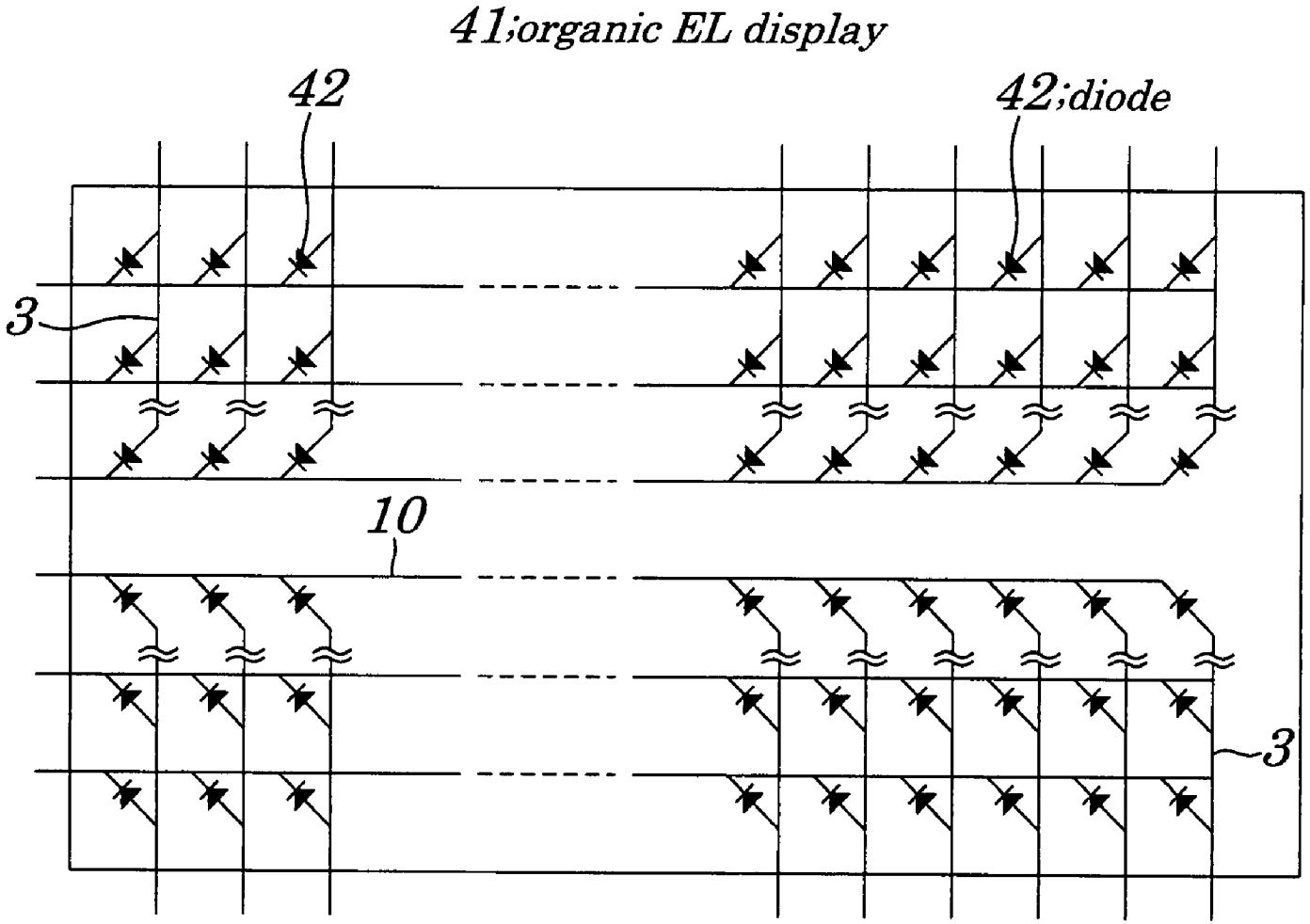
FIG. 8 is a schematic equivalent circuit diagram showing an example of another configuration of the organic EL display to which the present invention is applied.

It is apparent that the present invention is not limited to the above embodiments but may be changed and modified without departing from the scope and spirit of the invention. For example, in the above embodiments, the present invention is applied to the simple-matrix organic EL display 1, however, the present invention can be also applied to a passive-matrix organic EL display 41, as shown in FIG. 8, in which a diode 42 serving as a switching element is placed at an intersection of each of data electrodes 3 formed at specified intervals in a column direction and of each of scanning electrodes 10 formed at specified intervals in a row direction.

Also, in the above embodiments, each of the data electrode driving circuits 21, 22, 31, and 32 is made up of the IC and the output pin is placed in the lower end portion of the IC, however, the output pin may be mounted in an upper end portion of the IC. In this case, the data electrode driving circuits 22 and 32 are so mounted that the upper end portion of the data electrodes 22 and 32 are placed opposite to the lower end portion of the organic EL display 1, while the data electrode driving circuits 21 and 31 are so mounted that the lower end portion obtained by reversing each of the data electrode driving circuits 21 and 31 upside down is placed opposite to the upper end portion of the organic EL display 1.

Also, in the above first embodiment, the example is shown in which the current ratio between the bipolar transistors Q1 and Q3 is 1:6, however, the present invention is not limited to this. That is, the above current ratio may be calculated from an average value given by the slopes of both the curves "a" and "c" showing the applied voltage-luminance characteristic shown in FIG. 11 and a pulse width of the "high" control signal $S_{SW}$ to be applied to the driving section 23 used to drive the green color light emitting organic EL element $EL_G$ may be made different from the pulse width of the "high" control signal $S_{SW}$ to be applied to the driving section 23 used to drive the blue color light emitting organic EL element $EL_B$ (see the waveform (2) in FIG. 4). By configuring as above, power consumption can be more effectively reduced and display characteristics can be improved. Moreover, this method can be also applied to the second embodiment. That is, the pulse widths of the "high" control signal $S_{SW}$ to be applied to the driving sections 33, 24 and 34 may be made different from each other (see the waveform (2) in FIG. 4). This method may be also applied to a case in which there are variations in electrical characteristics by each of the organic EL display 1, that is, in each of the above embodiments, the pulse widths of the "high" control signal $S_{SW}$ to be applied to the driving sections 23, 24, 33, and 34 may be made different from each other (see the waveform (2) in FIG. 4). By configuring as above, the problem of variations in electrical characteristics of each of the organic EL display 1 can be solved, which leads to improvement of display characteristics.

In the above embodiments, any of the driving sections 23, 24, 33, and 34 is made up of the bipolar transistors, however, these driving sections may be constructed of MOSFETs (Metal Oxide Semiconductor FET).

In the above embodiments, the present invention is applied to the organic EL display 1 employing the double scanning method, however, the present invention may be applied to the organic EL display in which the data electrodes 3 are installed from the lower end toward the upper end of the display region and are routed from either of the lower end or the upper end outside the display region and are connected to data terminals formed at specified intervals in the upper or lower portion of the display region.

In the above embodiments, the present invention is applied to the organic EL display 1 in which the organic EL elements $EL_G$, $EL_R$, and $EL_B$ are arranged in the stripe form in order of the green color light emitting organic EL element $EL_G$, red color light emitting organic EL element $EL_R$, and blue color light emitting organic EL element $EL_B$ and in which the applied voltage-luminance characteristics or the applied voltage-current density characteristics of the red color light emitting organic EL element $EL_R$ differ greatly from those of the green color light emitting organic EL elements $EL_G$ and blue color light emitting organic EL element $EL_B$, however, the present invention is not limited to this. That is, the present invention may be applied to the stripe-type organic EL display which is made up of three types of the light emitting elements each emitting any one of three primary color light and in which electrical characteristics of the light emitting element adapted to emit one color light differ greatly from of those of two types of the light emitting elements adapted to emit light of other remaining two colors and in which the light emitting elements are so mounted that the former light emitting element is sandwiched by the latter two light emitting elements.

In the above embodiments, the present invention is applied to the organic EL display 1 which is made up of the organic EL element, however, the present invention may be applied to the "stripe" type display which is made up of an inorganic EL element, LED, VFD (FED being one of the VFD in particular) or a like. Even when there is the difference in the electric characteristics, in particular, in the applied voltage-current density characteristics, of the light emitting elements each being adapted to emit light of one of the three primary colors, the same effect can be achieved by the present invention.

Furthermore, the driving circuit of the display of the present invention can be applied to the display device equipped with the display used as monitors of a personal computer.

What is claimed is:

1. A display device, comprising:

a display, said display comprising a plurality of first color light emitting elements, a plurality of second color light emitting elements, and a plurality of third color light emitting elements;

a driving circuit for driving said plurality of first, second and third color light emitting elements, said driving circuit comprising:

first driving sections each having a driving capability to drive said first color light emitting elements in accordance with the electrical characteristic of said first color light emitting elements; and second driving sections each having a driving capability to drive at least one of said second color light emitting elements and said third color light emitting elements in accordance with the electrical characteristic of said at least one of said second color light emitting elements and said third color light emitting elements; and a controller receiving a video signal, a horizontal sync signal and vertical sync signal, wherein said controller applies a data signal and a horizontal scanning signal to said first and second driving sections and each of said first and second driving sections outputs a data having a current value based on said driving capability.

2. The display device of claim 1, wherein said driving capability of said first and second driving sections is based on a value given by a slope of a curve showing applied voltage-luminance characteristics of a corresponding said color light emitting element.

3. The display device of claim 1, wherein said driving capability of said second driving sections is based on an average value given by slopes of curves showing applied voltage-luminance characteristics of each of said second color light emitting elements and said third color light emitting elements.

4. The display device of claim 1, further comprising:

an integrated circuit inside which said integrated circuit, said first and second driving sections are arranged in said order in which said first driving sections are sandwiched by said second driving sections, in a sequentially repeated manner, from a left end portion toward a right end portion of said integrated circuit in a column direction and in a manner to correspond to said column-directional arrangement of said first, second and third color light emitting element; and in which, in a lower end portion or in an upper end portion of said integrated circuit, output pins are provided which are arranged from said left end portion to said right end portion of said integrated circuit at pitches being approximately equal to specified pitches at which data terminals are placed in either of the upper end portion or the lower end portion of said display, in a manner to correspond to said data terminals and an output terminal corresponding to each of said first and second driving sections arranged from said left end portion to said right end portion of said integrated circuit is connected to each of said output terminals.

5. The display device of claim 1, wherein said second driving sections drive said second color light emitting elements, said display device further comprising:

third driving sections each having a driving capability to drive said third color light emitting elements in accordance with the electrical characteristic of said third color light emitting elements.

6. The display device of claim 1, wherein said first driving sections and said second driving sections comprise a current mirror circuit.

7. The display device of claim 1, wherein said first driving sections comprise:

a first transistor; and a second transistor, wherein said electrical characteristic of said first color light emitting elements is achieved by having a first predetermined current ratio between said first transistor and said second transistor.

8. The display device of claim 1, wherein said second driving sections comprise:

a first transistor; and a second transistor, wherein said electrical characteristic of said second color light emitting elements is achieved by having a second predetermined current ratio between said first transistor and said second transistor.

9. The display device of claim 5, wherein said third driving sections comprise:

a first transistor; and a second transistor, wherein said electrical characteristic of said third color light emitting elements is achieved by having a third predetermined current ratio between said first transistor and said second transistor.

10. The display device of claim 1 wherein said display comprises a simple-matrix type in which said first, second and third color light emitting elements are placed at an intersection of each of a plurality of scanning electrodes arranged at specified intervals in a row direction and each of a plurality of data electrodes arranged at specified intervals in a column direction.

11. The display device of claim 1 wherein said display comprises a passive-matrix type in which said first, second and third color light emitting elements and a diode serving as a switching element are placed at an intersection of each of a plurality of scanning electrodes arranged at specified intervals in a row direction and each of a plurality of data electrodes arranged at specified intervals in a column direction.

12. The display device of claim 1, wherein said light emitting element comprises one of:

an electroluminescence element; and a light emitting diode.

13. The display device of claim 1, wherein said light emitting element comprises a vacuum fluorescent display.

14. A display device comprising:

a display, said display comprising a plurality of first color light emitting elements, a plurality of second color light emitting elements, and a plurality of third color light emitting elements;

a driving circuit for driving said plurality of first, second and third color light emitting elements, said driving circuit comprising:

first driving sections each having a driving capability to drive said first color light emitting elements in accordance with the electrical characteristic of said first color light emitting elements; and second driving sections each having a driving capability to drive at least one of said second color light emitting elements and said third color light emitting elements in accordance with the electrical characteristic of said at least one of said second color light emitting elements and said third color light emitting elements; and a controller receiving a video signal, a horizontal sync signal and vertical sync signal, wherein said controller applies a data signal and a horizontal scanning signal to said first and second driving sections and each of said first and second driving sections outputs a data having a current value based on said driving capability, wherein said display is so configured that a plurality of data electrodes are divided into two portions at an approximately central place of a display region and the divided data electrodes installed from said approximately central place toward an upper end portion of said display region are routed to an upper portion on an upper side of said display region, and each terminal portion of said divided data electrodes is connected to each of data terminals mounted at an upper end of said display at specified pitches, and wherein said divided data electrodes installed from said approximately central place toward a lower end portion of said display region are routed to a lower portion on a lower side of said display region, and wherein said each terminal portion of said divided data electrodes is connected to each of corresponding data terminals mounted at specified pitches.

* * * * *